US010830014B2

(12) United States Patent
Marya

(10) Patent No.: US 10,830,014 B2
(45) Date of Patent: Nov. 10, 2020

(54) COMPACT ELECTRICALLY ACTUATED CHEMICAL ENERGY HEAT SOURCE FOR DOWNHOLE DEVICES

(71) Applicant: Schlumberger Technology Corporation, Sugar Land, TX (US)

(72) Inventor: Manuel Marya, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 248 days.

(21) Appl. No.: 15/597,909

(22) Filed: May 17, 2017

(65) Prior Publication Data

US 2018/0334873 A1 Nov. 22, 2018

(51) Int. Cl.

| | |
|---|---|
| ***E21B 29/02*** | (2006.01) |
| ***F42D 1/045*** | (2006.01) |
| ***E21B 37/06*** | (2006.01) |
| ***E21B 33/13*** | (2006.01) |
| ***E21B 7/14*** | (2006.01) |
| ***E21B 41/00*** | (2006.01) |
| ***F42B 3/10*** | (2006.01) |
| ***F42B 3/26*** | (2006.01) |

(Continued)

(52) U.S. Cl.

CPC ..... *E21B 29/02* (2013.01); *E21B 7/14* (2013.01); *E21B 33/13* (2013.01); *E21B 37/06* (2013.01); *E21B 41/00* (2013.01); *F42B 3/10* (2013.01); *F42B 3/26* (2013.01); *F42B 12/36* (2013.01); *F42D 1/045* (2013.01); *F42B 3/00* (2013.01)

(58) Field of Classification Search

CPC ..... E21B 29/02; F42B 3/00; F42D 1/045

USPC ..... 166/311

See application file for complete search history.

(56) References Cited

U.S. PATENT DOCUMENTS 5,466,537 A * 11/1995 Diede ..... F02K 9/38 102/364

7,377,690 B1 5/2008 Diede (Continued)

OTHER PUBLICATIONS

Alumina metallic ceramic heating element (HTCC), http://www.induceramic.com/industrial-ceramics-application/electrical-equipment/heating-element/alumina-metallic-ceramic-heating-element-htcc, Induceramic 2017, pp. 1-12.

(Continued)

*Primary Examiner* — Taras P Bemko

(74) *Attorney, Agent, or Firm* — Eileen Pape

(57) ABSTRACT

A downhole tool includes a compact heat source including an inner housing having thermal insulation. The compact heat source includes an electrically activated heat source disposed in the inner housing and configured to receive electrical energy to generate first thermal energy. Additionally, the compact heat source includes active metal exothermic materials disposed in the inner housing and configured to receive the first thermal energy from the electrically activated heat source to initiate a first exothermic reaction in the active metal exothermic materials that generates second thermal energy. Further, the compact heat source includes a thermite material disposed in the inner housing. The thermite material is configured to receive the second thermal energy from the first exothermic reaction and ignite a second exothermic reaction of the thermite material to generate third thermal energy. Additionally, the compact heat source is configured to output the third thermal energy out of the inner housing.

20 Claims, 12 Drawing Sheets

(51) Int. Cl.
*F42B 12/36* (2006.01)
*F42B 3/00* (2006.01)

(56) References Cited

U.S. PATENT DOCUMENTS

| | | | | |
|---|---|---|---|---|
| 8,752,486 | B2 | 6/2014 | Robertson et al. | |
| 2011/0174504 | A1* | 7/2011 | Wright | E21B 23/04 166/386 |
| 2014/0137761 | A1* | 5/2014 | Robertson | C06B 33/02 102/531 |
| 2015/0211328 | A1* | 7/2015 | Lowry | C09K 8/00 166/300 |
| 2016/0130903 | A1* | 5/2016 | Robertson | E21B 29/02 166/298 |

OTHER PUBLICATIONS

Cartridge Heaters Low to Medium Watt Density, Hotwatt 2010 Catalog, p. 2.

Thermic Edge Vacuum Heating Technology, Graphite heating elements, http://www.ceramisis.com/carbons_graphites_heaters.htm, pp. 1-3.

* cited by examiner

COMPACT ELECTRICALLY ACTUATED CHEMICAL ENERGY HEAT SOURCE FOR DOWNHOLE DEVICES

BACKGROUND

This disclosure relates to a compact electrically actuated heat source to provide thermal energy to a downhole environment.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of any kind.

Heat sources having thermite are used in a broad range of applications. In the oilfield, heat sources having thermite are employed to perform tasks at well sites that involve melting or welding metals for use at the well site. As may be appreciated, the downhole environment may have little or no oxygen to assist in acquiring the high temperatures required to ignite the thermite of the heat sources. Accordingly, heat sources having thermite may be used at the surface of the well site, rather than downhole. These constraints, among other factors, may hinder the use of the heat sources having thermite in the downhole environment.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one example, a downhole tool includes a housing configured to be placed into a downhole environment and a compact heat source disposed in the housing. The compact heat source includes an inner housing having thermal insulation. Also, the compact heat source includes an electrically activated heat source disposed in the inner housing and configured to receive electrical energy to generate first thermal energy. Additionally, the compact heat source includes active metal exothermic materials disposed in the inner housing and configured to receive the first thermal energy from the electrically activated heat source to initiate a first exothermic reaction in the active metal exothermic materials that generates second thermal energy. Further, the compact heat source includes a thermite material disposed in the inner housing. The thermite material is configured to receive the second thermal energy from the first exothermic reaction and ignite a second exothermic reaction of the thermite material to generate third thermal energy. Additionally, the compact heat source is configured to output the third thermal energy out of the inner housing.

In another example, a method includes placing a downhole tool into a wellbore. The method also includes activating a downhole heat source at least in part by causing electrical energy to be provided to an electrically activated heat source in the downhole tool, generating first thermal energy. Additionally, the first thermal energy initiates a first exothermic reaction in active metal exothermic materials disposed in the downhole tool, generating second thermal energy. Further, the second thermal energy initiates a second exothermic reaction in thermite disposed in the downhole tool, generating third thermal energy. The method further includes outputting the third thermal energy into the wellbore.

In a further example, a compact heat source includes a housing and a first heat source configured to be selectively activated to generate first thermal energy. The compact heat source also includes a second heat source disposed in the housing. The second heat source is configured to be activated by the first thermal energy. Additionally, the second heat source includes at least two metals that produce a first exothermic reaction in response to the first thermal energy. Further, the first exothermic reaction is configured to generate second thermal energy. The compact heat source also includes a thermal insulation channel configured to concentrate the second thermal energy at an output of the thermal insulation channel. Additionally, the compact heat source includes a third heat source in the housing. The third heat source is configured to be activated by the concentrated second thermal energy. Also, the third heat source includes thermite that produces a second exothermic reaction in response to the concentrated second thermal energy. Further, the second exothermic reaction is configured to generate third thermal energy. The compact heat source further includes an output seal that encapsulates the third heat source in the housing. The output seal is configured to be expelled or melted by the second exothermic reaction to permit the third thermal energy to exit the compact heat source.

Technical effects of the present disclosure include the activation and use of a compact heat source of a downhole tool for performing various tasks in a downhole environment and/or wellbore. The compact heat source including the electrical actuator, active metal exothermic materials, and thermite materials may provide considerable thermal energy for use in the downhole environment having limited or no oxygen content. Additional exothermic materials may be included in the compact heat source or ignited by the compact heat source. Thus, tasks as varied as degrading and/or melting another downhole tool disposed in a wellbore, melting a sealant for plugging and/or water shut off in the inside the wellbore, assisting in forming metal seals in the wellbore, removing scale in the wellbore, removing a contaminant in the wellbore, igniting a payload outside of the downhole tool to melt and/or blast rocks in the geological formation, and/or igniting further thermite materials to perform other downhole tasks may be performed in the downhole environment using the disclosed systems and techniques.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

Figure 1:
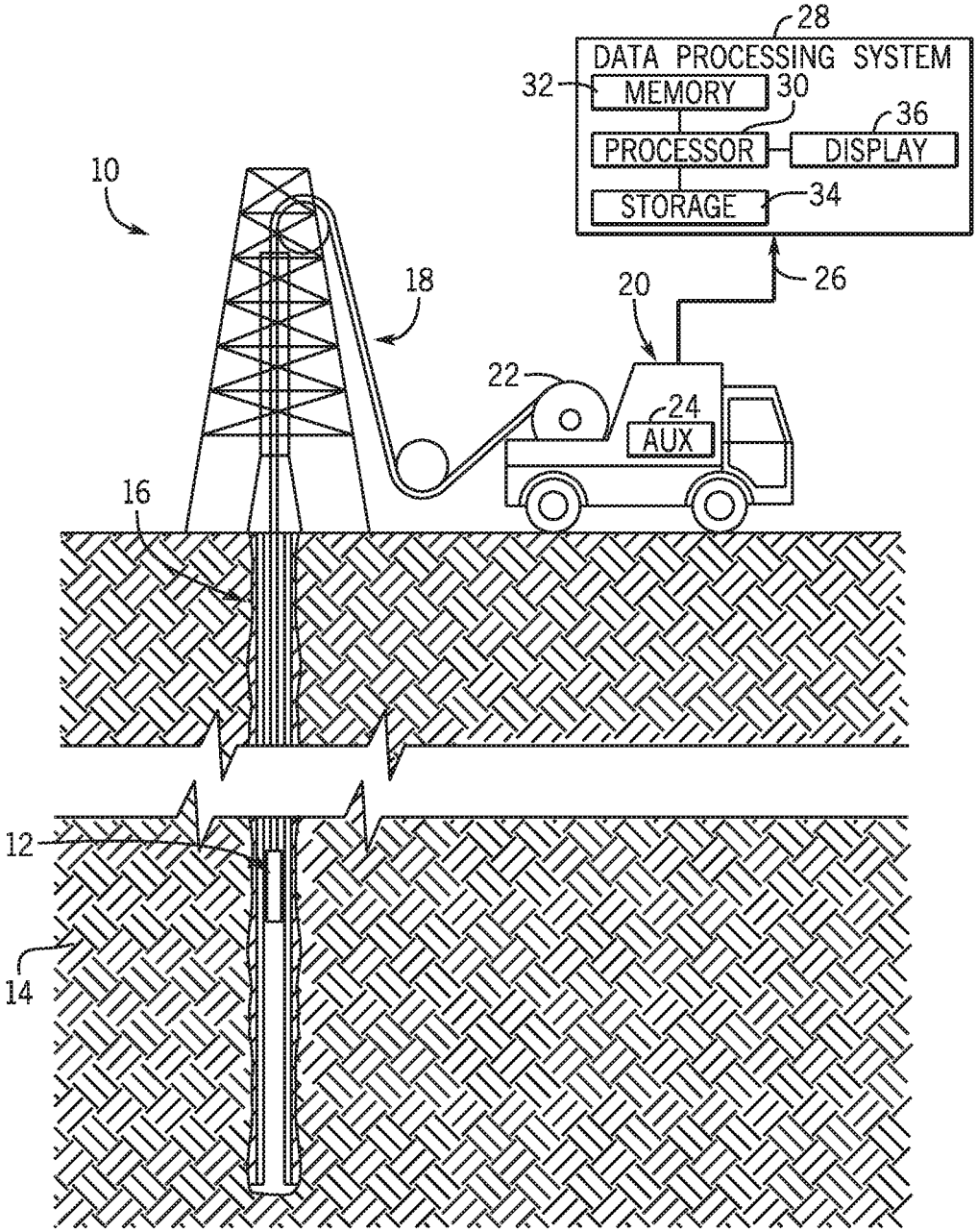
FIG. 1 is a schematic diagram of a drilling system that includes a downhole tool to provide thermal energy for downhole applications, in accordance with an embodiment.

One or more specific embodiments of the present disclosure will be described below. These described embodiments are examples of the presently disclosed techniques. Additionally, in an effort to provide a concise description of these embodiments, certain features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Different downhole tools may be used for performing different tasks in a downhole environment. For example, a downhole tool may include a compact heat source to perform tasks such as degrading and/or melting another downhole tool disposed in a wellbore, melting a sealant for plugging and/or water shut off in the inside the wellbore, assisting in forming metal seals in the wellbore, removing scale in the wellbore, removing a contaminant in the wellbore, igniting a payload outside of the downhole tool to melt and/or blast rocks in the geological formation, and/or igniting further thermite materials to perform other downhole tasks.

To perform the tasks, the compact heat source may include thermite materials capable of reaching very high temperatures and/or releasing considerable thermal energy. The compact heat source may include an electrically activated heat source, active metal exothermic materials, and the thermite material within a common, thermally insulated housing. Additionally, to ignite the thermite materials in the downhole environment having reduced or no oxygen, the compact heat source may employ the electrical actuator. For example, the electrical actuator may be a thermistor, a heat cartridge, or another suitable device that transfers electrical energy to thermal energy. The compact heat source may be activated when the electrical actuator of the compact heat source receives electrical energy. Then, the electrical actuator generates thermal energy that proceeds to melt the active metal exothermic materials of the compact heat source. The active metal exothermic materials perform an exothermic reaction that produces further thermal energy. Then, the further thermal energy may produce an energy density or thermal energy sufficient to ignite the thermite materials of the compact heat source. Once ignited, the thermite materials of the compact heat source may be utilized by the downhole tool to perform the above-mentioned tasks. In this manner, some embodiments of downhole tools described below may include the compact heat source to utilize a small amount of electrical energy to ignite thermite in a downhole environment without oxygen. Further, it is to be understood that additional exothermic materials, such as additional active metal exothermic materials or thermite materials, may be included in the compact heat source or ignited by the compact heat source to perform the downhole tasks.

With the foregoing mind, FIG. 1 illustrates a well-logging system 10 that may employ the systems and methods of this disclosure. The well-logging system 10 may be used to convey a downhole tool 12 through a geological formation 14 via a wellbore 16. In the example of FIG. 1, the downhole tool 12 is conveyed on a cable 18 via a logging winch system (e.g., vehicle) 20. Although the logging winch system 20 is schematically shown in FIG. 1 as a mobile logging winch system carried by a truck, the logging winch system 20 may be substantially fixed (e.g., a long-term installation that is substantially permanent or modular). Any suitable cable 18 for well logging may be used. The cable 18 may be spooled and unspooled on a drum 22 and an auxiliary power source 24 may provide energy to the logging winch system 20 and/or the downhole tool 12.

Moreover, while the downhole tool 12 is described as a wireline downhole tool, it should be appreciated that any suitable conveyance may be used. For example, the downhole tool 12 may instead be conveyed as a logging-while-drilling (LWD) tool as part of a bottom hole assembly (BHA) of a drill string, conveyed on a slickline or via coiled tubing, and so forth. For the purposes of this disclosure, the downhole tool 12 may be any suitable downhole tool that uses a heat source to perform work within the wellbore 16 (e.g. downhole environment).

As discussed further below, the downhole tool 12 may receive energy from an electrical energy device or an electrical energy storage device, such as the auxiliary power source 24 or another electrical energy source to ignite thermite materials. Additionally, in some embodiments the downhole tool 12 may include a power source within the downhole tool 12, such as a battery system or a capacitor to store sufficient electrical energy to activate the compact heat source and ignite the thermite materials. The ignited thermite materials may be used by the downhole tool to perform tasks, such as degrading and/or melting another downhole tool disposed in the wellbore 16, melting a sealant for plugging and/or water shut off in the inside the wellbore 16, assisting in forming metal seals in the wellbore 16, removing scale in the wellbore 16, removing a contaminant in the wellbore 16, igniting a payload outside of the downhole tool 12 to melt and/or blast rocks in the geological formation 14, and/or igniting further thermite materials to perform other downhole tasks.

Control signals 25 may be transmitted from a data processing system 28 to the downhole tool 12 to activate the compact heat source within the downhole tool 12. Additionally, data related to the actions of the compact heat source may be detected by the downhole tool 12 as data 26 relating the compact heat source. The data 26 may be sent to the data processing system 28. The data processing system 28 may be any electronic data processing system that can be used to carry out the systems and methods of this disclosure. For example, the data processing system 28 may include a processor 30, which may execute instructions stored in memory 32 and/or storage 34. As such, the memory 32 and/or the storage 34 of the data processing system 28 may be any suitable article of manufacture that can store the instructions. The memory 32 and/or the storage 34 may be read-only memory (ROM), random-access memory (RAM), flash memory, an optical storage medium, or a hard disk drive, to name a few examples. A display 36, which may be any suitable electronic display, may display images generated by the processor 30. The data processing system 28 may be a local component of the logging winch system 20 (e.g., within the downhole tool 12), a remote device that analyzes data from other logging winch systems 20, a device located proximate to the drilling operation, or any combination thereof. In some embodiments, the data processing system 28 may be a mobile computing device (e.g., tablet, smart phone, or laptop) or a server remote from the logging winch system 20.

Figure 2:
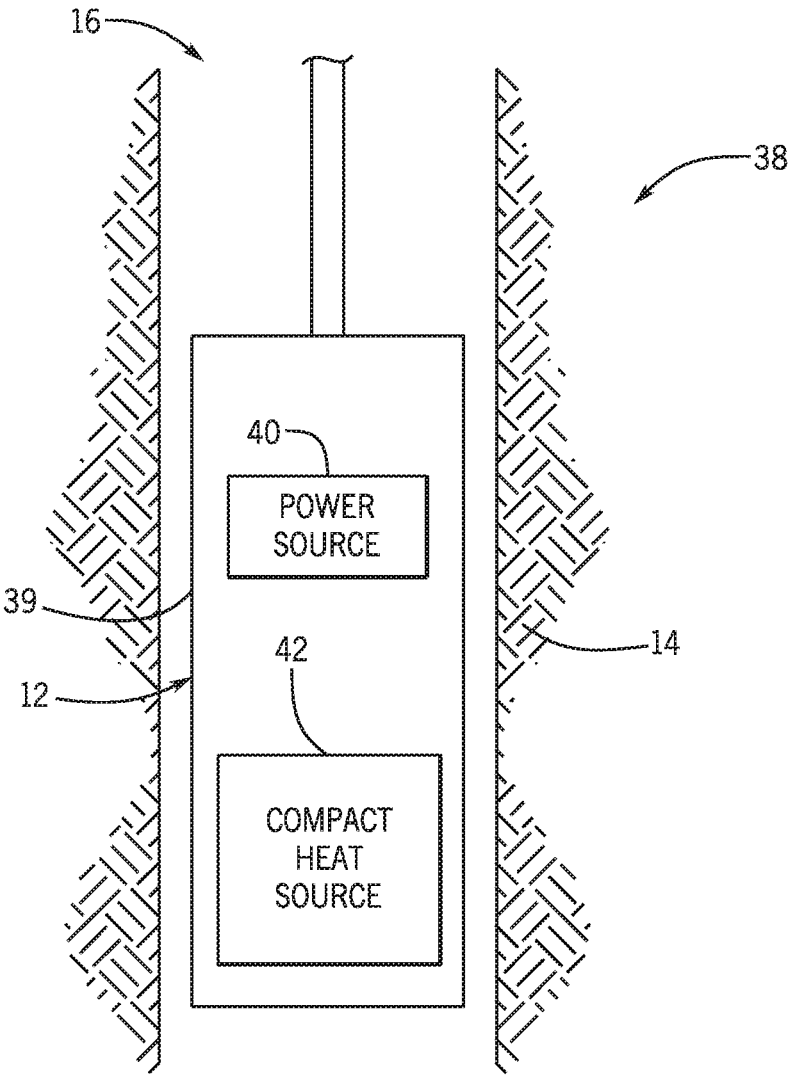
FIG. 2 is a block diagram of the downhole tool of FIG. 1 that includes a compact heat source for downhole applications, in accordance with an embodiment.

FIG. 2 is a block diagram of the downhole tool 12 that performs work in a downhole environment 38. The downhole environment 38 may generally include the geological formation 14 and/or the wellbore 16. Within a housing 39, the downhole tool 12 may include a power source 40, such as a battery, a connection to the auxiliary power source 24 of FIG. 1, or another suitable power source. The downhole tool 12 may also include a compact heat source 42 having an electrical actuator, active metal exothermic materials, and thermite material. The downhole tool 12 may use a small amount of electrical energy from the power source 40 to activate the compact heat source 42. For example, the electrical energy may be provided to the electrical actuator of the compact heat source 42, which generates thermal energy. The thermal energy from the electrical actuator may then proceed to melt the active metal exothermic materials, which release more thermal energy within the compact heat source 42. Then, the thermal energy from the active metal exothermic materials may proceed to ignite the thermite material, which generates further thermal energy that the downhole tool 12 may use to complete tasks in the downhole environment 38.

Figure 3:
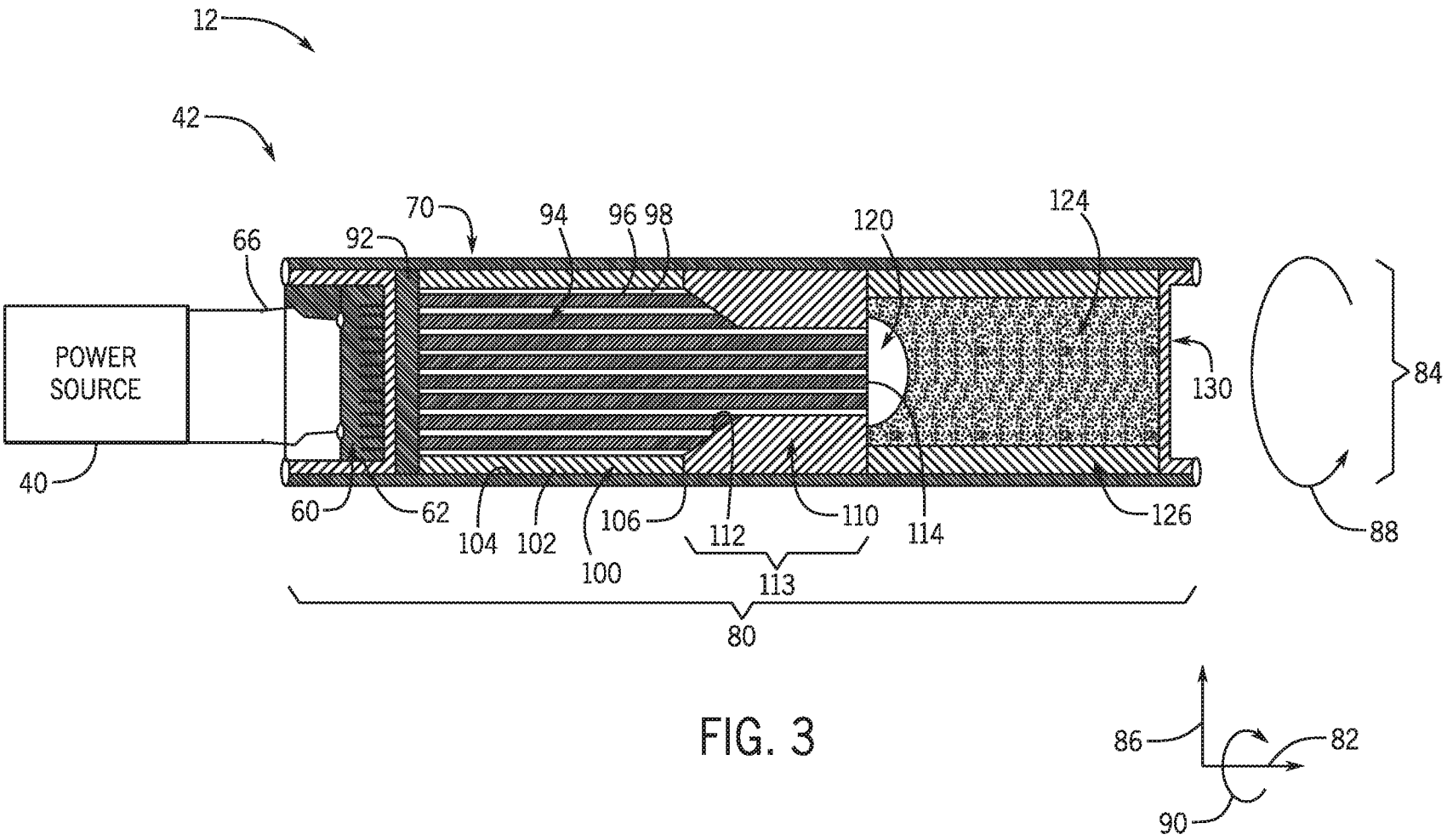
FIG. 3 is a schematic diagram of the compact heat source of FIG. 2 having an electrical actuator for use in a downhole environment, in accordance with an embodiment.

FIG. 3 is a schematic diagram of an embodiment of the compact heat source 42 having an electrical actuator 60 for use in a downhole environment. The compact heat source 42 may be used in any suitable downhole tool 12. In the illustrated embodiment, the electrical actuator 60 includes a thermistor element 62 electrically coupled to the power source 40 via electrical conductors 66 (e.g., wires). In some embodiments, the power source 40 provides the thermistor element 62 with electrical energy via A/C power or D/C power. The power source 40 may provide the electrical energy from the downhole tool 12, from a battery and/or a capacitor within the downhole tool 12, from the auxiliary power source 24, or from another suitable source of electrical energy.

The thermistor element 62 may include one or more element wires (e.g., conductors, resistive heating element) to transfer electrical energy into thermal energy. Accordingly, the element wires may have high resistivity, long length, and/or small cross-sectional area to increase the efficiency of thermal energy production from electrical energy. Additionally, the thermistor element 62 may include ceramic and/or other thermally resistant materials in order to produce high temperatures at or above 500° C., 600° C., 700° C., or more. As such, the thermistor element 62 may be able to deliver a power density at or above 10 W/cm$^2$. The element wires may include metals, alloys, and/or ceramics including tungsten, molybdenum, and other high temperature metals, alloys, and/or ceramics. The element wires may be disposed within a ceramic substrate having high electrical insulating properties (e.g., dielectric properties). The ceramic substrate may therefore occupy the largest space of the thermistor element 62. In some embodiments, the ceramic substrate may include alumina, magnesia, or oxides.

To activate the compact heat source 42, a small amount of energy may be input to the thermistor element 62. For example, the thermistor element may be activated when 5 Watts (W), 20 W, 80 W, 100 W, 200 W, 250 W, or another suitable, low input of electrical energy is provided to the thermistor element 62 from the power source 40. By transferring the electrical energy into thermal energy, the thermistor element 62 may therefore release a significant amount of thermal energy per area, or energy density. That is, the thermistor element 62 may utilize a low W input to produce a high W/cm$^2$ output. Further, the flow of electrical energy to the thermistor element 62 may be controlled by a switch within the electrical conductors 66, or another device for controlling the flow of electrical energy to electrically actuated devices. It should be appreciated that because the compact heat source 42 is powered by the electrical energy from the power source 40, materials within the compact heat source 42 may be activated in environments with reduced or limited oxygen content, such as downhole environments.

To retain the thermal energy generated by the thermistor element 62 within the compact heat source 42, the compact heat source 42 may include an insulated housing 70 (e.g., inner housing). The insulated housing 70 may circumferentially surround other components of the compact heat source 42. For example, the insulated housing 70 may be a cylindrically shaped housing including thermally insulating materials, such as ceramic or refractory materials. Additionally, the insulated housing 70 may be of any suitable shape for enclosing materials of the compact heat source 42 to retain thermal energy within the compact heat source 42. In embodiments in which the compact heat source 42 is cylindrically shaped, the compact heat source has a length 80 extending in a longitudinal direction 82, a diameter 84 extending in a vertical direction 86, and a circumference 88 around a circumferential direction 90. Additionally, the compact heat source 42 may be hermetically sealed, having compacted materials disposed within the insulated housing 70.

The thermal energy released by the thermistor element 62 may flow through the compact heat source 42 to provide energy to other components of the compact heat source 42. For example, in some embodiments, the compact heat source 42 includes a longitudinally insulating element 92 adjacent to the thermistor element 62 in the longitudinal direction 82. The longitudinally insulating element 92 may accumulate at least a portion of the thermal energy from the thermistor element 62. The longitudinally insulating element 92 may be a ceramic disk disposed within the insulated housing 70. Accordingly, as the thermal energy from the thermistor element 62 builds, the longitudinally insulating element 92 may transfer energy to additional components within the thermally insulated housing 70.

The compact heat source 42 may additionally include active metal exothermic materials 94 adjacent to the longitudinally insulating element 92 in the longitudinal direction 82. The active metal exothermic materials 94 may receive a portion of the thermal energy that the longitudinally insulating element receives from the thermistor element 62. Accordingly, the active metal exothermic materials 94 may be activated to generate thermal energy via exothermic reactions. The exothermic reactions may be initiated via the thermal energy of the thermistor element 62. In some embodiments, the longitudinally insulating element 92 may be omitted and the thermal energy from the thermistor element 62 may be transferred directly to the active metal exothermic materials 94.

To produce further thermal energy, the active metal exothermic materials 94 may include two or more active metals or active alloys of metals. The active metal exothermic materials 94 may be activated (e.g., ignited, actuated) based on the thermal energy from the thermistor element 62. The metals within the active metal exothermic materials 94 may be characterized as active metals because the active metal exothermic materials 94 have a positive enthalpy of formation. For example, when melted, the active metal exothermic materials 94 may undergo exothermic chemical reactions to form new compounds and to release thermal energy. The active metal exothermic materials 94 may therefore include materials with melting points that are below the temperatures the thermistor element 62 may produce, so that the active metal exothermic materials 94 may be melted by the thermal energy from the thermistor element 62 to initiate the exothermic reactions. Some examples of suitable metals and/or alloys that may be included in the active metal exothermic materials 94 include lithium combined with tin and lead, indium combined with selenium, gallium combined with selenium, among others. The active metal exothermic materials 94 may be disposed within the insulated housing 70 as tightly compacted powders, thin wires, thin films, or other suitable structural forms. As shown, a first active metal exothermic material 96 and a second active metal exothermic material 98 are disposed within the compact heat source 42 as thin films. Indeed, the active metal exothermic materials 94 may be more efficient at initiating exothermic reactions if the active metal exothermic materials 94 have at least one dimension which is no more than approximately (e.g., within 10% of) 100 micrometers.

To retain the thermal energy produced by the active metal exothermic materials 94 within the compact heat source 42, the compact heat source 42 may include a first circumferentially insulating element 100 disposed around the active metal exothermic materials 94 in the circumferential direction 90. As shown, the first circumferentially insulating element 100 has an outer surface 102 in contact with an inner surface 104 of the insulated housing 70. In some embodiments, the first circumferentially insulating element 100 may be integrally formed with the insulated housing 70, omitted, or disposed on an outer surface 106 of the insulated housing 70. However, disposing the first circumferentially insulating element 100 within the insulated housing 70 may provide a smoother outer surface 106 of the insulated housing or may provide an easier manufacturing process for the compact heat source 42.

Further, to channel and/or concentrate the thermal energy produced by the active metal exothermic materials 94, the compact heat source 42 may additionally include a thermal choke 110 (e.g., thermal channeling element) disposed around at least a portion of the active metal exothermic materials 94. The thermal choke 110 may be disposed within the insulated housing 70, adjacent at least a portion of the active metal exothermic materials 94 in the longitudinal direction 82. Further, the thermal choke 110 may circumferentially surround a portion of the active metal exothermic materials 94 in the circumferential direction 90. In some embodiments, the thermal choke 110 is formed from the same thermally resistant materials as the longitudinally insulating element 92, the first circumferentially insulating element 100, and the insulated housing 70. However, the thermal choke 110 may be made of different materials as well.

As shown, the thermal choke 110 may be an annular ring having a conical inner surface 112 disposed along at least a portion of a length 113 of the thermal choke 110. The conical inner surface 112 of the thermal choke 110 may permit the thermal energy produced by the active metal exothermic materials 94 to channel into a smaller space as the thermal energy moves along the longitudinal direction 82. That is, the thermal energy generated by the exothermic reactions in a first portion of the active metal exothermic materials 94 proceed to flow to subsequent portions of the active metal exothermic materials 94, melting more of the active metal exothermic materials 94 and releasing further thermal energy. However, the thermal choke 110 reduces the volume the thermal energy may occupy without permitting the thermal energy to leave the compact heat source 42. Accordingly, the thermal choke 110 increases an energy density of the active metal exothermic materials 94 within the compact heat source 42 compared to compact heat sources without thermal chokes. The thermal energy from the active metal exothermic materials 94 may result in a temperature at a longitudinal end 114 (e.g., interface) of the active metal exothermic materials 94 in excess of 500° C., 700° C., 900° C., or higher. Further, because the thermal energy may be concentrated in a smaller volume adjacent to the thermal choke 110, the longitudinal end 114 of the active metal exothermic materials 94 may further correspond with a very high energy density achieved by a relatively small quantity of the active metal exothermic materials 94. In some embodiments, the energy density at the longitudinal end 114 of the active metal exothermic materials 94 may be as high as 50 W/cm2, 100 W/cm2, 150 W/cm2, or more.

In some embodiments, the longitudinal end 114 of the active metal exothermic materials 94 may be in contact with a chemical trigger 120 (e.g., secondary chemical trigger, secondary chemical trigger material). The chemical trigger 120 may include additional active metal exothermic materials or thermite materials. The chemical trigger 120 may receive the thermal energy from the active metal exothermic materials 94, and then produce further thermal energy via exothermic reactions. In some embodiments, the chemical trigger 120 may not be present.

Further along the longitudinal direction 82, a thermite material 124 may be disposed within the insulated housing 70 and in contact with the chemical trigger 120. In some embodiments, the thermite material 124 may be surrounded by a second circumferentially insulating 126 that is similar to the first circumferentially insulating element 100 discussed above. However, because the thermite material 124 may produce greater amounts of thermal energy that the active metal exothermic materials 94 that the first circumferentially insulating element 100 surrounds, the second circumferentially insulating element 126 may be of a greater thickness or heat resistance than the first circumferentially insulating element 100.

The chemical trigger 120 may release both the thermal energy received from the active metal exothermic materials 94 and the thermal energy that the chemical trigger 120 produces into thermite material 124. In embodiments without the chemical trigger 120, the thermal energy from the active metal exothermic materials 94 may transfer directly to the thermite material 124. Further, as the thermite material 124 receives the thermal energy, the thermite material 124 may ignite (e.g., activate). Ignition of the thermite material 124 may utilize a high temperature (e.g., a temperature in excess of 1500° C.) or a high energy density. The thermite material 124 may generally include chemicals that undergo exothermic reduction-oxidation (redox) reactions (e.g., thermite reactions). One or more thermite reactions may occur within the thermite material 124 to increase the thermal energy within the compact heat source 42. For example, some non-limiting examples of thermite reactions are represented by Equations 1-4 below, in which the reactants on the left side equations 1-4 produce new compounds and release large amounts of thermal energy.

$$Fe_2O_3+2Al \rightarrow Al_2O_3+2Fe \quad (1)$$

$$3FeO+2Al \rightarrow Al_2O_3+3Fe \quad (2)$$

$$3Fe_3O_4+8Al \rightarrow 4Al_2O_3+9Fe \quad (3)$$

$$3CuO+2Al \rightarrow Al_2O_3+3Cu \quad (4)$$

However, it is to be understood that many types of thermite reactions may be utilized within the compact heat source 42. By way of an additional non-limiting example, one or more compounds within Table 1 below may be utilized as oxides in thermite reactions.

TABLE 1

| Oxides for Thermite Reactions. |
|---|
| Iron(III) Oxide - $Fe_2O_3$ |
| Iron(II, III) Oxide - $Fe_3O_4$ |
| Copper(II) Oxide - CuO |
| Copper(I) Oxide - $Cu_2O$ |
| Tin(IV) Oxide - $SnO_2$ |
| Titanium(IV) Oxide - $TiO_2$ |
| Manganese(IV) Oxide - $MnO_2$ |
| Manganese(III) Oxide - $Mn_2O_3$ |

TABLE 1-continued

| Oxides for Thermite Reactions. |
|---|
| Chromium(III) Oxide - $Cr_2O_3$ |
| Cobalt(II) Oxide - CoO |
| Silicon Dioxide - $SiO_2$ |
| Nickel(II) Oxide - NiO |
| Vanadium(V) Oxide - $V_2O_5$ |
| Silver(I) Oxide - $Ag_2O$ |
| Molybdenum(VI) Oxide - $MoO_3$ |

Once ignited by the secondary chemical trigger 120, the thermite materials 124 may continue to undergo thermite reactions until most or a portion thermite reactants are reacted. It should be appreciated that characteristics of the thermite material 124 may be manipulated to release a desired amount of thermal energy from the thermite material 124. For example, the chemical composition of the thermite material 124 may be varied to produce different types of thermite reactions. Additionally, the quantity of thermite material 124 may be varied to adjust an overall amount of thermal energy delivered from the compact heat source 42. The dimensions of the thermite material 124 may also be varied to adjust the manner in which the thermite reactions proceed, to adjust the area available for igniting the thermite, and/or to adjust the area available for using the ignited thermite to perform tasks. As the thermite reactions progress, the temperature of the thermite may be generally increased to above 3000° C. Accordingly, the compact heat source 42 may, based on a small amount of electrical power, ignite thermite for uses in downhole environments.

As shown, the thermite material 124 may be disposed adjacent to a cap 130 of the compact heat source 42. The cap 130 may retain the thermite material 124 and other components of the compact heat source 42 within the compact heat source 42 before the compact heat source 42 is activated by the power source 40. The cap 130 may be generally be formed of any material suitable for retaining the unignited thermite material 124 within the compact heat source 42. Once thermite material 124 in contact with the cap 130 is ignited, the thermal energy from the thermite material 124 may remove the cap 130 from the compact heat source 42. For example, in response to the thermal energy from the thermite material 124, the cap 130 may be expelled or melted from the compact heat source 42. In some embodiments, the thermal energy from the thermite material 124 may pass through the cap 130 without expelling or melting the cap 130 from the compact heat source 42. In some embodiments, the cap 130 may be omitted and the thermite material 124 may include a bonding agent or other adhesive components to retain the thermite material 120 within the insulated housing 70.

The thermal energy released from the thermite material 124 may be of a very high temperature. In some embodiments, the thermite material 124 may be ignited to produce local temperatures greater than 2000° C., 2500° C., 3000° C., or higher. The thermal energy from the thermite material 124 may leave the compact heat source 42 and enter the downhole environment 38. Accordingly, the thermal energy from the thermite materials 124 may be used to perform many useful tasks in the downhole environment 38.

For example, the thermal energy from the thermite material 124 may be used to perform tasks such as degrading and/or melting another downhole tool disposed in the wellbore 16, melting a sealant for plugging and/or water shut off in the inside the wellbore 16, assisting in forming metal seals in the wellbore 16, removing scale in the wellbore 16, removing a contaminant in the wellbore 16, igniting a payload outside of the downhole tool 12 to melt and/or blast rocks in the geological formation 14, and/or igniting further thermite materials to perform other downhole tasks. Further, additional exothermic materials, such as additional active metal exothermic materials or thermite materials, may be included in the compact heat source 42 or ignited by the compact heat source 42 to perform the downhole tasks. The high thermal energy requirements for performing the tasks may be achieved by a small quantity of electrical energy provided to the compact heat source 42. The heat may even be generated in oxygen free or oxygen reduced environments, such as downhole environments. Additionally, more than one compact heat source 42 may be included in the downhole tool 12 to perform multiple tasks or to ensure that at least one of the compact heat sources 42 will perform tasks as desired.

While the compact heat source 42 has been described as a generally cylindrical device, it is to be understood that compact heat sources that employ the embodiments discussed herein may have different shapes. For example, compact heat sources may be shaped as triangular prisms, rectangular prisms, other prisms, cones, spheres, or other suitable shapes. The components of the compact heat sources may be modified to suit the other shapes accordingly. For example, if the compact heat source is generally shaped as a cone, the power source may be provided to a thermistor within the base of the cone, which provides thermal energy to activate active metal exothermic materials, which provide further thermal energy to ignite thermite materials disposed adjacent to a tip of the cone. Because the cone naturally includes a generally conical inner surface, such as the conical inner surface of 112 of the thermal choke 110, thermal chokes may be omitted in embodiments of compact heat sources shaped as cones. Further, adjustments to the thermally insulating components of the compact heat sources may be made to adjust for changes to the shapes and components of the compact heat sources. Accordingly, the discussion herein is intended merely as an example of the compact heat source for downhole applications.

Figure 4:
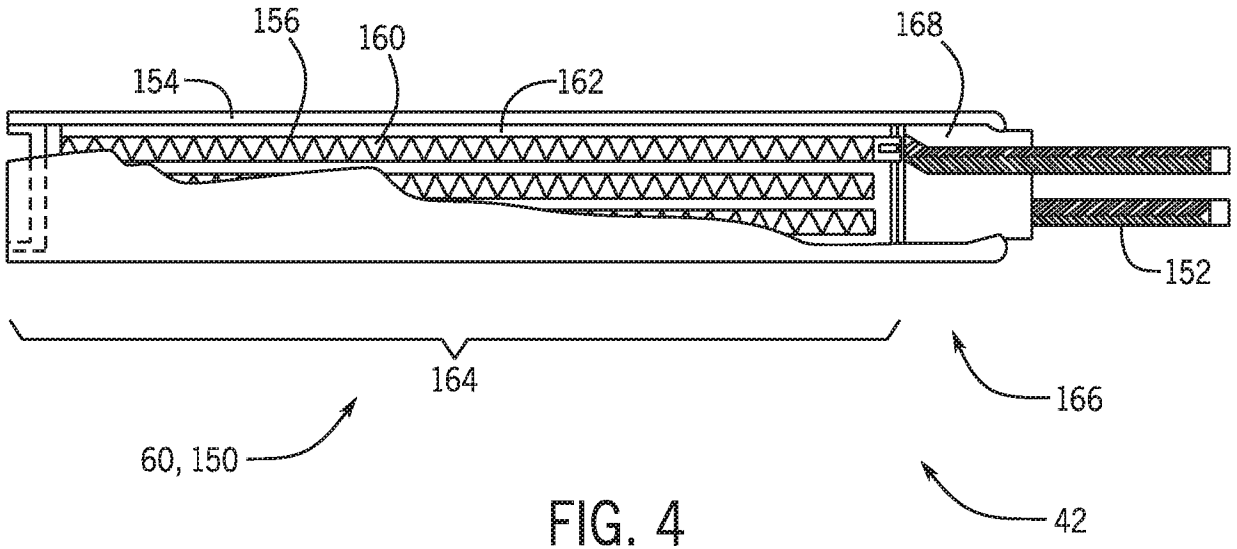
FIG. 4 is a cutaway schematic of an embodiment of an electrical actuator that may be used within the compact heat source of FIG. 2, in accordance with an embodiment.

Looking more closely at the electrical actuator 60, FIG. 4 is a cutaway schematic of an embodiment of the electrical actuator 60 that may be used within the compact heat source 42. As shown, the electrical actuator 60 is a heat cartridge 150 that includes electrical leads 152 that may connect the electrical actuator 60 to a power source. Based on electrical energy provided from the power source, the electrical actuator 60 may then generate thermal energy used within the compact heat source 42 to activate active metal exothermic materials 94 and thermite materials 124.

The electrical actuator 60 also includes a casing 154 (e.g., sheath) disposed around other components of the electrical actuator 60. The casing 154 may be generally cylindrical, rectangular, or another suitable shape. In some embodiments, the casing 154 may include stainless steel. Within the casing 154, the electrical actuator 60 may include element wires 156 (e.g., resistive heating elements) disposed within packing 160. The packing 160 may be $MO_x$ packing or another packing suitable for receiving heat from the element wires 156. The electrical actuator 60 may include multiple element wires separated by ceramic supports 162. The ceramic supports 162 may extend a longitudinal length 164 of the electrical actuator to provide support to the multiple element wires 156 and packing 160. Further, a ceramic cap 168 may be disposed at a longitudinal end 166 of the electrical actuator 60. The ceramic cap 168 may provide a supportive connection for the ceramic supports 162. Additionally, the ceramic cap 168 may protect other components such as the power source from thermal energy developed by the electrical actuator 60. The ceramic cap 168 may also provide structural support for the electrical leads 160.

In some embodiments, the electrical leads 160 may be fixed to an outer surface 170 of the ceramic cap 168. In some embodiments, the electrical leads 152 may pass through the outer surface 170 of the ceramic cap 168 and inside the casing 154. Electrical energy from the power source may be provided through the electrical leads 152, which are coupled to the element wires 156. As electrical energy passes through the element wires 156, the element wires release thermal energy to the packing 160 and the ceramic supports 162. Then, the thermal energy may conduct through the casing 154 of the electrical actuator 60 and into a desired space, such as an inside of the compact heat source 42. By including one or more of the element wires 156 with high resistivity, long length, and/or small cross-sectional area, the electrical actuator 60 may be very efficient at converting electrical energy to thermal energy for use within the compact heat source. Further, the electrical actuator 60 may be powered by batteries to increase a maneuverability of the compact heat source as compared to heat sources having high energy demands and/or larger electrical connections.

Figure 5:
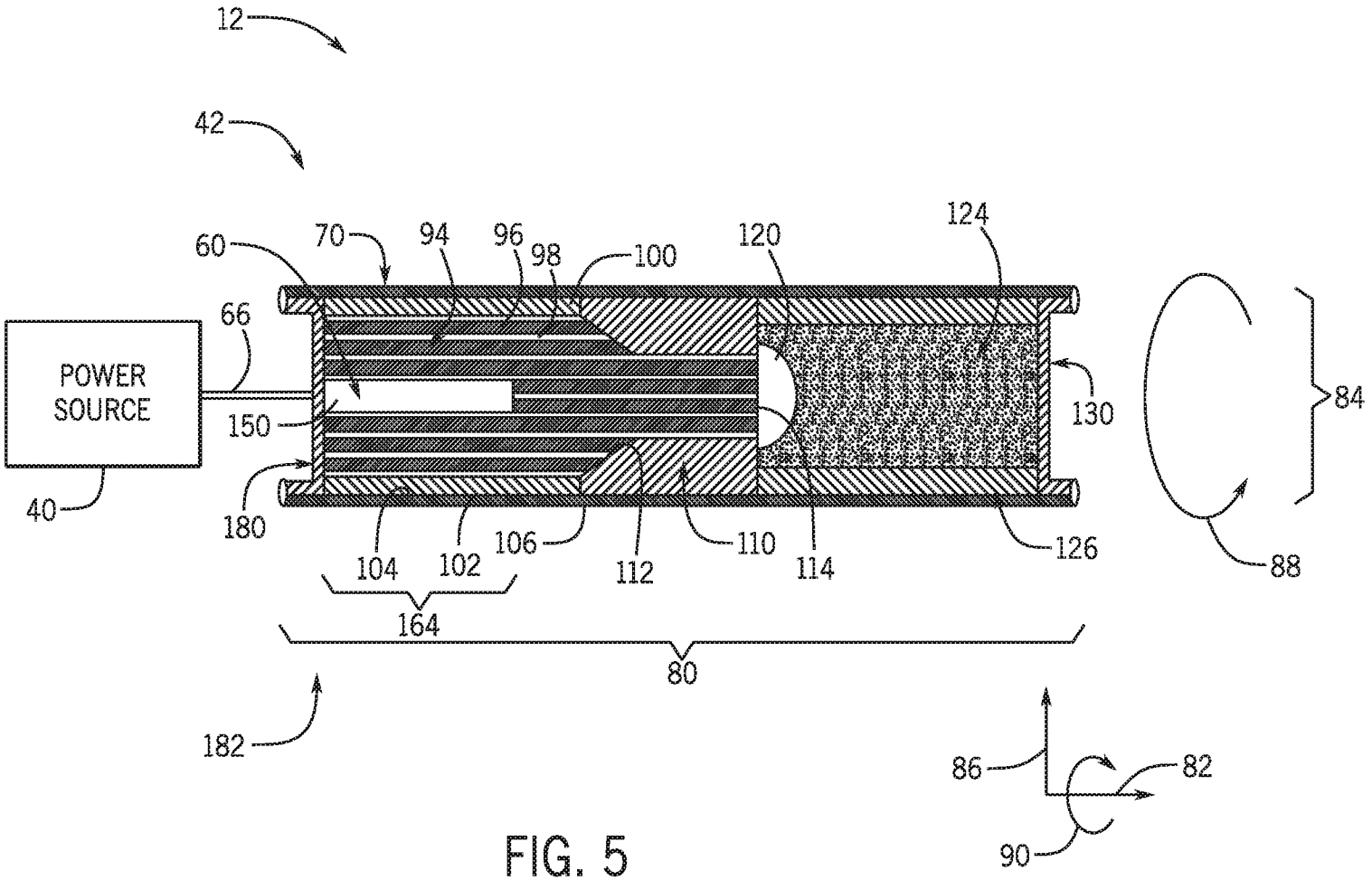
FIG. 5 is a schematic diagram of the compact heat source of FIG. 2 having an electrical actuator for use in a downhole environment, in accordance with an embodiment.

FIG. 5 is an embodiment of the compact heat source 42 using the heat cartridge 150 of FIG. 4 as an electrical actuator 60. As shown, compact the heat source 42 of FIG. 5 has many similar elements as the compact heat source 42 of FIG. 3. These similar elements are denoted by identical reference numerals. In place of the thermistor element 62 of FIG. 3, the heat cartridge 150 is disposed within the active metal exothermic materials 94. That is, the active metal exothermic materials at least partially surround the heat cartridge 150. Therefore, electrical energy from the power source 40 travels along the electrical conductors 66 and into the electrical actuator 60 (e.g., heat cartridge 150) to directly melt and activate the active metal exothermic materials 94. That is, as the electrical energy is transferred into thermal energy by element wires of the electrical actuator 60, the thermal energy enters the active metal exothermic materials 94 to initiate the exothermic reactions.

The exothermic reactions may initiate along the longitudinal length 164 of the electrical actuator 60. In some embodiments, the compact heat source 42 may include a second cap 180 disposed at a second longitudinal end 182 of the compact heat source 42. The second cap 180 may be generally similar to the cap 130 disposed at the opposite longitudinal end of the compact heat source 42. The second cap 180 may be an insulating material that retains the thermal energy generated by the electrical actuator 60 within the compact heat source 42. The second cap 180 may additionally include an opening for the electrical conductors 66 to enter the electrical actuator 60.

The thermal energy generated by the electrical actuator 60 is received by the active metal exothermic materials 94. The active metal exothermic materials 94 combine to initiate exothermic reactions that release further thermal energy within the compact heat source 42. The thermal energy may conduct through the compact heat source 42 along the longitudinal direction 82 and channel through the thermal choke 110. The thermal choke 110 may increase the energy density of the thermal energy produced by the active metal exothermic materials 94 to a sufficient level to ignite the chemical trigger 120. Then, the thermal trigger may produce more thermal energy and maintain a high temperature against the thermite materials 120 to ignite the thermite materials.

Once ignited, the thermite materials 124 may be used to perform downhole operations within the downhole environment 12, such as degrading and/or melting another downhole tool disposed in the wellbore 16, melting a sealant for plugging and/or water shut off in the inside the wellbore 16, assisting in forming metal seals in the wellbore 16, removing scale in the wellbore 16, removing a contaminant in the wellbore 16, igniting a payload outside of the downhole tool 12 to melt and/or blast rocks in the geological formation 14, and/or igniting further thermite materials to perform other downhole tasks. Accordingly, the compact heat source 42 may translate a very small amount of electrical energy into thermite reactions that produce very high temperatures usable for downhole tasks.

Figure 6:
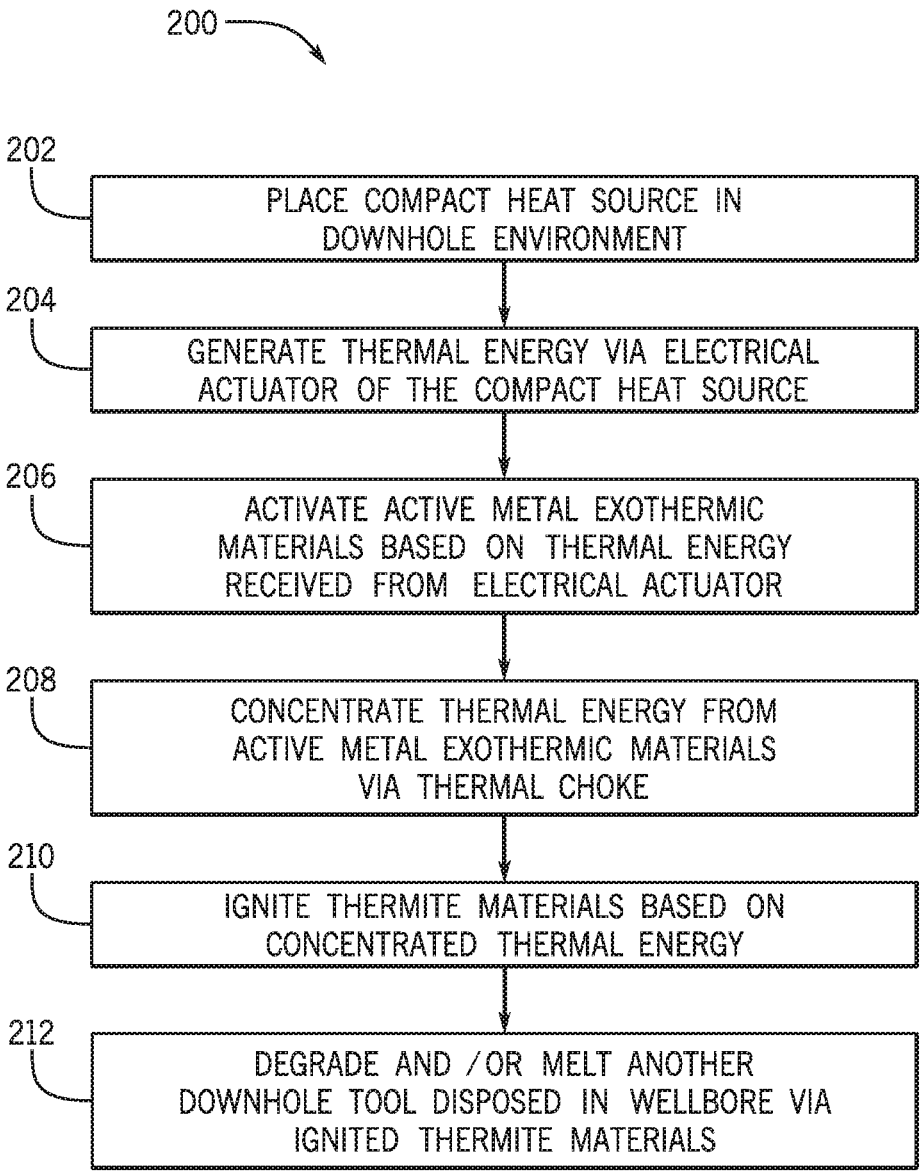
FIG. 6 is a flowchart of a method for using the compact heat source of FIG. 2 to degrade and/or melt another downhole tool disposed in a wellbore, in accordance with an embodiment.

The above-described compact heat source 42 may be utilized within a downhole tool 12 for many applications, some of which are described below. FIG. 6 is a flowchart of a method 200 for using the compact heat source 42 to degrade and/or melt another downhole tool disposed in the wellbore 16, in accordance with an embodiment. Although the following description of the method 200 is described as being performed by the downhole tool 12, it should be noted that the method 200 may be performed by any suitable downhole tool. Moreover, although the method 200 is described as being performed in a particular order, it should be understood that the method 200 may be performed in any suitable order and is not limited to the order presented herein.

Referring now to FIG. 6, at block 202, the downhole tool 12 may place the compact heat source 42 in the downhole environment 38. That is, in some embodiments, the downhole tool 12 may include the compact heat source 42 within the housing 39 of the downhole tool 12, so when the downhole tool is conveyed into the downhole environment 38, the compact heat source 12 is placed within the downhole environment 38. In some embodiments, the downhole tool 12 may use the compact heat source 42 within the housing 39 of the downhole 12. In some embodiments, the downhole tool 12 may include the compact heat source 42 on an outer surface of the downhole tool 12, or the downhole tool 12 may move the compact heat source 42 to outside of the housing 39 of the downhole tool 12 after the downhole tool has entered the downhole environment.

At block 204, the downhole tool 12 may generate thermal energy within the compact heat source 62 via the electrical actuator 60 of the compact heat source 42. The downhole tool 12 may provide the electrical actuator 60 with power via the auxiliary power source 24, batteries and/or capacitors coupled to the electrical actuator 60, or another power source within the downhole tool 12. The electrical actuator 60 may be the thermistor element 62, the heat cartridge 150, or another suitable electrical actuator.

At block 206, the active metal exothermic materials 94 within the compact heat source 42 may be activated based on thermal energy received from the electrical actuator 60. That is, based on the thermal energy produced by the electrical actuator 60, one or more metals and/or alloys of the active metal exothermic materials 94 may melt to initiate exothermic reactions. The exothermic reactions may then provide further thermal energy to the active metal exothermic materials 94, until most or a portion of the active metal exothermic materials 94 have reacted and generated thermal energy.

At block 208, the thermal energy from the active metal exothermic materials 94 may be concentrated via the thermal choke 110. The thermal choke 110 may concentrate the thermal energy from the active metal exothermic materials 94 into a smaller space, therefore increasing the energy density of the active metal exothermic materials 94 near the longitudinal end 114 of the active metal exothermic materials 94. In embodiments having the secondary chemical trigger 120, the thermal energy from the active metal exothermic materials 94 may travel first through the chemical trigger 120 to activate further exothermic reactions before providing increased thermal energy to the thermite materials 124. Therefore, the concentrated thermal energy from the active metal exothermic materials 94 and the thermal choke 110 may proceed to activate the secondary chemical trigger 120 before proceeding to block 210.

At block 210, the thermite materials 124 may ignite based on the concentrated thermal energy produced by the active metal exothermic materials 94 and the thermal choke 110. In some embodiments, the active metal exothermic materials 94 may directly contact the thermite materials 124. In such embodiments, the thermite materials 124 are ignited after receiving the thermal energy from the active metal exothermic materials 94. In some embodiments, the compact heat source 42 may include the activated chemical trigger 120 that ignites the thermite materials 124.

At block 212, the ignited thermite materials 124 may be employed to degrade and/or melt another downhole tool disposed in the wellbore 16 via the thermal energy produced by the ignited thermite materials 124. For example, the other downhole tool may be melted by the very high temperatures produced by the thermite materials 124. In this manner, the compact heat source 42 may remove a downhole tool blocking the wellbore 16. Additionally, the ignited thermite materials 124 may be used to degrade (e.g., corrode) materials within the downhole environment 38. Degradation may be indicated by a substantial reduction of material that was previously present in the downhole environment 38. For example, the ignited thermite materials 124 may be used to open conduits and/or remove packers within the downhole environment 38. Accordingly, the compact heat source 42 may be employed to perform downhole tasks in the downhole environment 38 having little or no oxygen.

Figure 7:
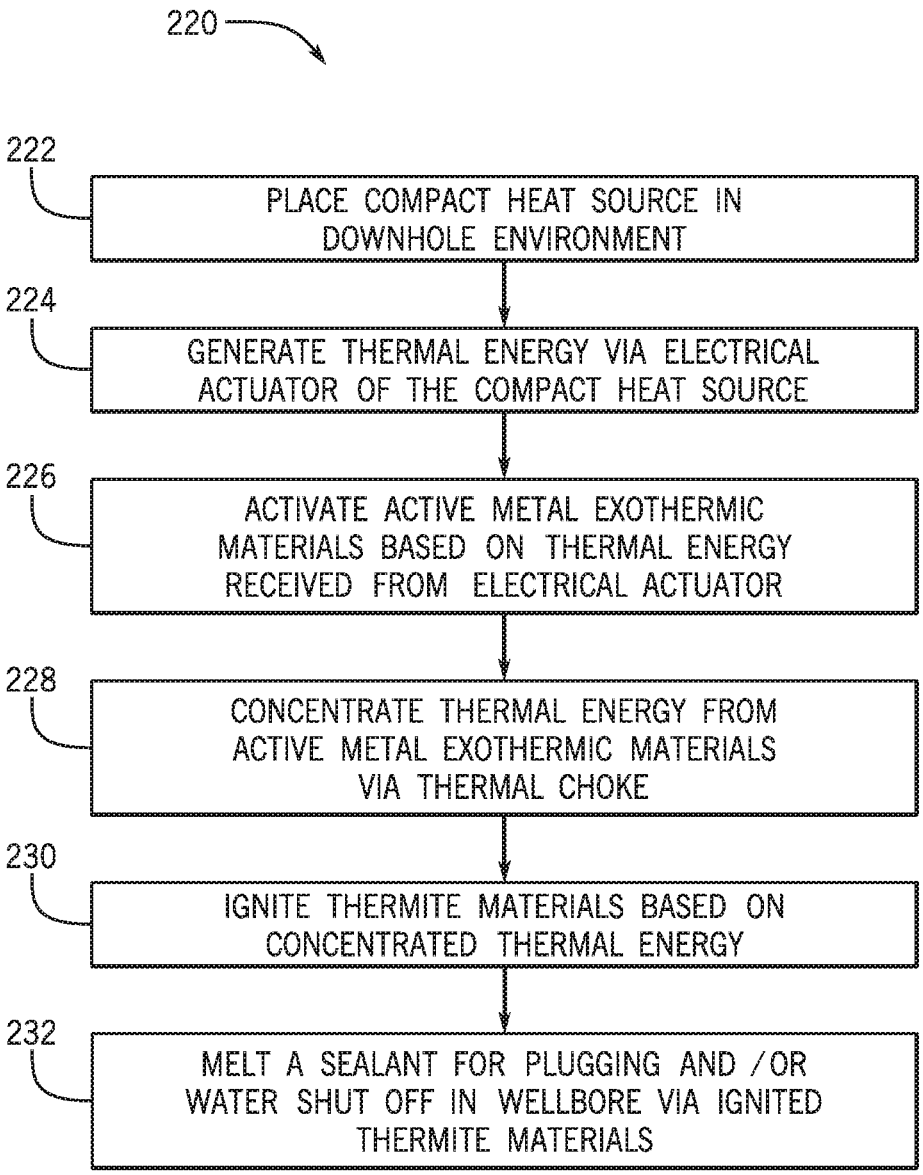
FIG. 7 is a flowchart of a method for using the compact heat source of FIG. 2 to melt a sealant for plugging and/or for water shut off in the wellbore, in accordance with an embodiment.

FIG. 7 is a flowchart of a method 220 for using the compact heat source 42 to melt a sealant for plugging and/or for water shut off in the wellbore 16, in accordance with an embodiment. Although the following description of the method 220 is described as being performed by the downhole tool 12, it should be noted that the method 220 may be performed by any suitable downhole tool. Moreover, although the method 220 is described as being performed in a particular order, it should be understood that the method 220 may be performed in any suitable order and is not limited to the order presented herein. Further, it should be noted that block 222, block 224, block 226, block 228, and block 230 of the method 220 correspond respectively to block 202, block 204, block 206, block 208, and block 210 of method 200 of FIG. 6. That is, the blocks of the method 220 are similar to the blocks of the method 200 of FIG. 6, such that the thermite materials 124 of the compact heat source 42 are ignited similarly by the method 220 as by the method 200 of FIG. 6.

At block 232, the ignited thermite materials 124 may be employed to melt a sealant for plugging and/or for water shut off in the wellbore 16 via the thermal energy produced by the ignited thermite materials 124. Additionally, the sealant may be applied to the wellbore 16 for blocking a flow of water in the wellbore 16 or for plugging the wellbore 16. Accordingly, the compact heat source 42 may be employed to perform downhole tasks in the downhole environment 38 having little or no oxygen.

Figure 8:
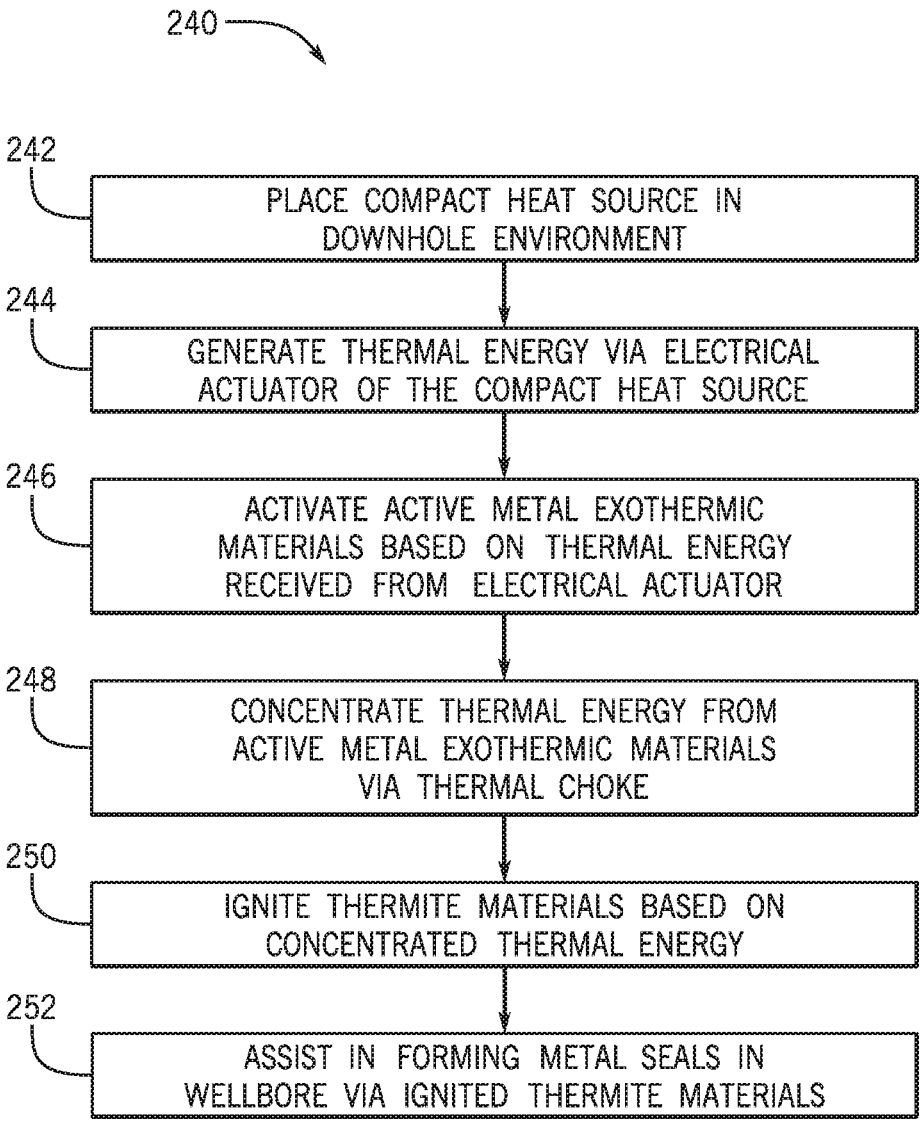
FIG. 8 is a flowchart of a method for using the compact heat source of FIG. 2 to assist in forming metal seals in the wellbore, in accordance with an embodiment.

FIG. 8 is a flowchart of a method 240 for using the compact heat source 42 to assist in forming metal seals in the wellbore 16, in accordance with an embodiment. Although the following description of the method 240 is described as being performed by the downhole tool 12, it should be noted that the method 240 may be performed by any suitable downhole tool. Moreover, although the method 240 is described as being performed in a particular order, it should be understood that the method 240 may be performed in any suitable order and is not limited to the order presented herein. Further, it should be noted that block 242, block 244, block 246, block 248, and block 250 of the method 240 correspond respectively to block 202, block 204, block 206, block 208, and block 210 of method 200 of FIG. 6. That is, the blocks of the method 240 are similar to the blocks of the method 200 of FIG. 6, such that the thermite materials 124 of the compact heat source 42 are ignited similarly by the method 240 as by the method 200 of FIG. 6.

At block 252, the ignited thermite materials 124 may be employed to assist in forming metal seals in the wellbore 16 via the thermal energy produced by the ignited thermite materials 124. In this manner, the ignited thermite materials 124 may be advantageously utilized to melt the components including metal for forming the metal seals that are then applied to an inner surface of the wellbore 16. Additionally, the ignited thermite materials 124 may be used to repair previously formed metals seals in the wellbore 16. Accordingly, the compact heat source 42 may be employed to perform downhole tasks in the downhole environment 38 having little or no oxygen.

Figure 9:
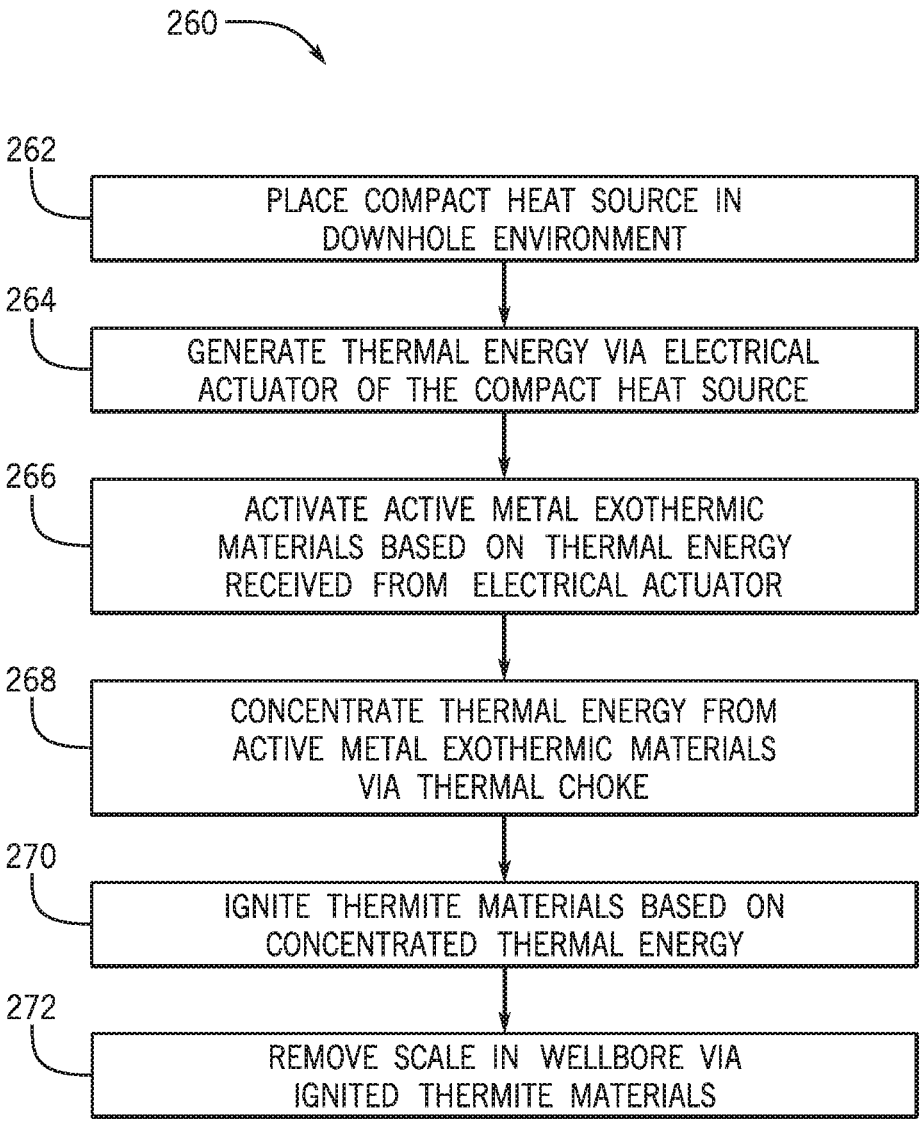
FIG. 9 is a flowchart of a method for using the compact heat source of FIG. 2 to remove scale in the wellbore, in accordance with an embodiment.

FIG. 9 is a flowchart of a method 260 for using the compact heat source 42 to remove scale in the wellbore 16, in accordance with an embodiment. Although the following description of the method 260 is described as being performed by the downhole tool 12, it should be noted that the method 260 may be performed by any suitable downhole tool. Moreover, although the method 260 is described as being performed in a particular order, it should be understood that the method 260 may be performed in any suitable order and is not limited to the order presented herein. Further, it should be noted that block 262, block 264, block 266, block 268, and block 270 of the method 260 correspond respectively to block 202, block 204, block 206, block 208, and block 210 of method 200 of FIG. 6. That is, the blocks of the method 260 are similar to the blocks of the method 200 of FIG. 6, such that the thermite materials 124 of the compact heat source 42 are ignited similarly by the method 260 as by the method 200 of FIG. 6.

At block 272, the ignited thermite materials 124 may be employed to remove scale in the wellbore 16 via the thermal energy produced by the ignited thermite materials 124. In this manner, the ignited thermite materials 124 may be advantageously utilized to remove scale from the wellbore that may otherwise affect operations of the wellbore 16. For example, if not removed, the scale may even form an undesired plug in the wellbore 16. In some embodiments, the scale may include compounds that are at least partially insoluble in water. For example, the scale may include calcium carbonate, calcium sulfate, barium sulfate, strontium sulfate, iron sulfide, iron oxides, iron carbonate, various silicates, various phosphates, and/or various oxides. Accordingly, the compact heat source 42 may be employed to perform downhole tasks in the downhole environment 38 having little or no oxygen.

Figure 10:
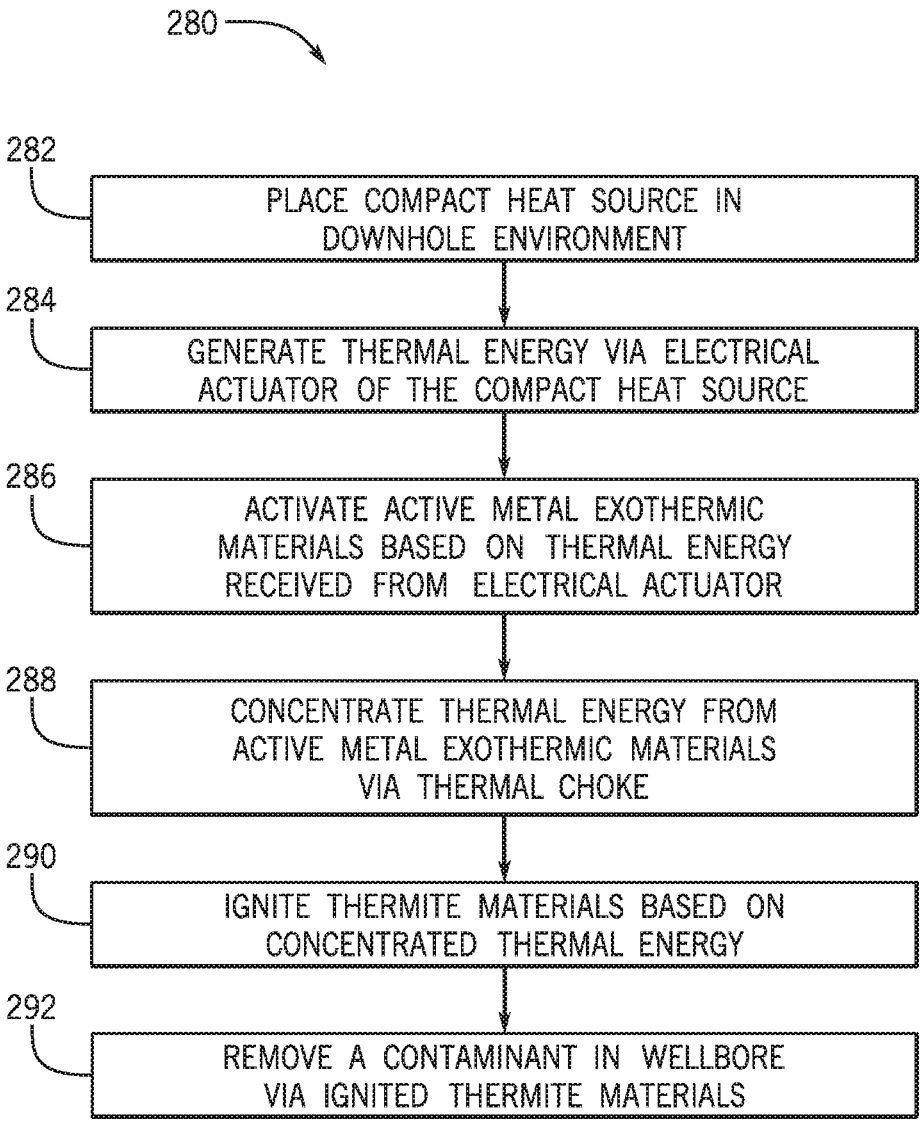
FIG. 10 is a flowchart of a method for using the compact heat source of FIG. 2 to remove a contaminant in the wellbore, in accordance with an embodiment.

FIG. 10 is a flowchart of a method 280 for using the compact heat source 42 to remove a contaminant in the wellbore 16, in accordance with an embodiment. Although the following description of the method 280 is described as being performed by the downhole tool 12, it should be noted that the method 280 may be performed by any suitable downhole tool. Moreover, although the method 280 is described as being performed in a particular order, it should be understood that the method 280 may be performed in any suitable order and is not limited to the order presented herein. Further, it should be noted that block 282, block 284, block 286, block 288, and block 290 of the method 280 correspond respectively to block 202, block 204, block 206, block 208, and block 210 of method 200 of FIG. 6. That is, the blocks of the method 280 are similar to the blocks of the method 200 of FIG. 6, such that the thermite materials 124 of the compact heat source 42 are ignited similarly by the method 280 as by the method 200 of FIG. 6.

At block 292, the ignited thermite materials 124 may be employed to remove a contaminant in the wellbore 16 via the thermal energy produced by the ignited thermite materials 124. In this manner, the ignited thermite materials 124 may be advantageously utilized to remove the contaminant from the wellbore that may otherwise affect operations of the wellbore 16. For example, if not removed, the contaminant may degrade and/or pollute fluids in the wellbore 16. Accordingly, the compact heat source 42 may be employed to perform downhole tasks in the downhole environment 38 having little or no oxygen.

Figure 11:
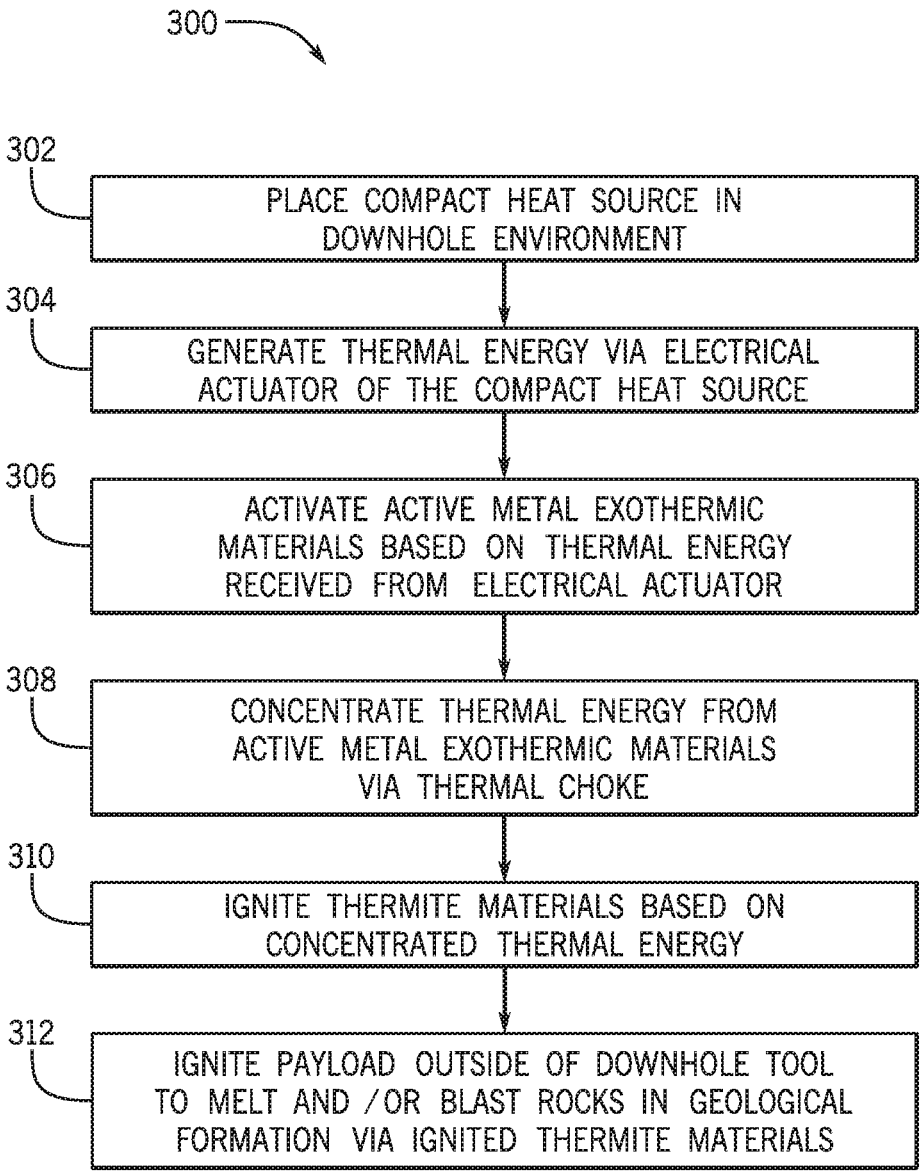
FIG. 11 is a flowchart of a method for using the compact heat source of FIG. 2 to ignite a payload to melt and/or blast rocks of a geological formation, in accordance with an embodiment.

FIG. 11 is a flowchart of a method 300 for using the compact heat source 42 to ignite a payload disposed outside of the downhole tool 12 to melt and/or blast rocks of the geological formation 14, in accordance with an embodiment. Although the following description of the method 300 is described as being performed by the downhole tool 12, it should be noted that the method 300 may be performed by any suitable downhole tool. Moreover, although the method 300 is described as being performed in a particular order, it should be understood that the method 300 may be performed in any suitable order and is not limited to the order presented herein. Further, it should be noted that block 302, block 304, block 306, block 308, and block 310 of the method 300 correspond respectively to block 202, block 204, block 206, block 208, and block 210 of method 200 of FIG. 6. That is, the blocks of the method 300 are similar to the blocks of the method 200 of FIG. 6, such that the thermite materials 124 of the compact heat source 42 are ignited similarly by the method 300 as by the method 200 of FIG. 6.

At block 312, the ignited thermite materials 124 may be employed to ignite the payload disposed outside of the downhole tool 12 to melt and/or blast rocks of the geological formation 14 via the thermal energy produced by the ignited thermite materials 124. In this manner, the ignited thermite materials 124 may be advantageously utilized to modify or remove at least a portion of the geological formation 14. Accordingly, the compact heat source 42 may be employed to perform downhole tasks in the downhole environment 38 having little or no oxygen.

Figure 12:
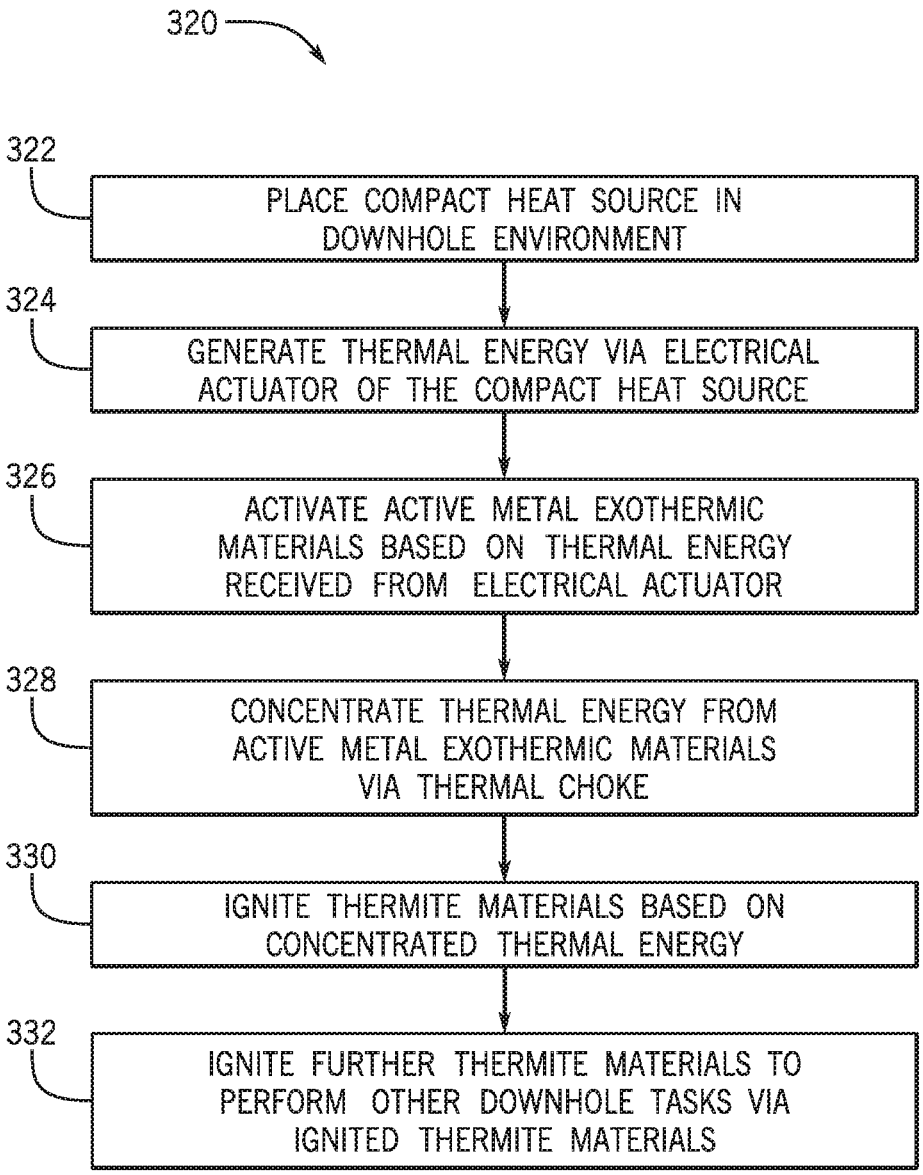
FIG. 12 is a flowchart of a method for using the compact heat source of FIG. 2 to ignite further thermite materials to perform other downhole tasks, in accordance with an embodiment.

FIG. 12 is a flowchart of a method 320 for using the compact heat source 42 to ignite further thermite materials to perform other downhole tasks, in accordance with an embodiment. Although the following description of the method 320 is described as being performed by the downhole tool 12, it should be noted that the method 320 may be performed by any suitable downhole tool. Moreover, although the method 320 is described as being performed in a particular order, it should be understood that the method 320 may be performed in any suitable order and is not limited to the order presented herein. Further, it should be noted that block 322, block 324, block 326, block 328, and block 330 of the method 320 correspond respectively to block 202, block 204, block 206, block 208, and block 210 of method 200 of FIG. 6. That is, the blocks of the method 320 are similar to the blocks of the method 200 of FIG. 6, such that the thermite materials 124 of the compact heat source 42 are ignited similarly by the method 320 as by the method 200 of FIG. 6.

At block 332, the ignited thermite materials 124 may be employed to ignite further thermite materials to perform other downhole tasks via the thermal energy produced by the ignited thermite materials 124. In this manner, the ignited thermite materials 124 may be advantageously utilized to ignite further thermite materials that may otherwise be difficult to ignite in the downhole environment 38. Accordingly, the compact heat source 42 may be employed to perform downhole tasks in the downhole environment 38 having little or no oxygen.

The specific embodiments described above have been shown by way of example, and it should be understood that these embodiments may be susceptible to various modifications and alternative forms. It should be further understood that the claims are not intended to be limited to the particular forms disclosed, but rather to cover modifications, equivalents, and alternatives falling within the spirit and scope of this disclosure.

The invention claimed is:

1. A downhole tool comprising:

a housing configured to be placed into a downhole environment; and a compact heat source disposed in the housing, wherein the compact heat source comprises:

an inner housing having thermal insulation disposed therein, the inner housing having a conical inner surface and the thermal insulation configured to retain thermal energy within the compact heat source;

an electrically activated heat source disposed in the inner housing and configured to receive electrical energy to generate first thermal energy;

active metal exothermic materials disposed in the inner housing and thermal insulation and disposed at least partially within the conical inner surface of the inner housing, the active metal exothermic materials configured to receive the first thermal energy from the electrically activated heat source to initiate a first exothermic reaction in the active metal exothermic materials that generates second thermal energy; and a thermite material disposed in the inner housing, wherein the thermite material is configured to:

receive the second thermal energy from the first exothermic reaction; and ignite a second exothermic reaction of the thermite material to generate third thermal energy;

wherein the compact heat source is configured to output the third thermal energy out of the inner housing.

2. The downhole tool of claim 1, wherein the conical inner surface forms part of a thermal choke disposed around at least a portion of the active metal exothermic materials, and wherein the thermal choke is configured to channel the third thermal energy into a smaller space and increase an energy density at an interface between the active metal exothermic materials and the thermite material.

3. The downhole tool of claim 1, wherein the thermite comprises a secondary chemical trigger material at an interface between the active metal exothermic materials and the thermite material.

4. The downhole tool of claim 1, comprising an electrical energy storage device disposed within the housing, wherein the electrical energy storage device is configured to provide the electrical energy to the electrically activated heat source.

5. The downhole tool of claim 4, wherein the electrical energy storage device comprises a battery or a capacitor, or a combination thereof, configured to store sufficient electrical energy to enable the electrically activated heat source to generate sufficient thermal energy to initiate the first exothermic reaction in the active metal exothermic materials.

6. The downhole tool of claim 1, wherein the downhole tool is configured to receive the electrical energy from a cable via a power source not disposed in the housing of the downhole tool.

7. The downhole tool of claim 1, wherein the compact heat source is configured to output the third thermal energy into the downhole environment.

8. The downhole tool of claim 1, wherein the electrically activated heat source comprises a resistive heating element.

9. The downhole tool of claim 1, wherein the active metal exothermic materials at least partially surround the electrically activated heat source.

10. A method comprising:

placing a downhole tool into a wellbore;

activating a downhole heat source having an inner housing with thermal insulation disposed therein, the inner housing having a conical inner surface and the thermal insulation configured to retain thermal energy within the downhole heat source, at least in part by:

causing electrical energy to be provided to an electrically activated heat source in the downhole tool, generating first thermal energy;

wherein the first thermal energy initiates a first exothermic reaction in active metal exothermic materials disposed in the inner housing and thermal insulation and disposed at least partially within the conical inner surface of the inner housing, generating second thermal energy; and wherein the second thermal energy initiates a second exothermic reaction in thermite disposed in the downhole tool, generating third thermal energy; and outputting the third thermal energy into the wellbore.

11. The method of claim 10, wherein outputting the third thermal energy into the wellbore comprises degrading or melting, or both, another downhole tool disposed in the wellbore.

12. The method of claim 10, wherein outputting the third thermal energy into the wellbore comprises melting a sealant for plugging or water shut off, or both, inside the wellbore.

13. The method of claim 10, wherein outputting the third thermal energy into the wellbore comprises removing scale in the wellbore.

14. The method of claim 10, wherein outputting the third thermal energy into the wellbore comprises melting a material comprising metal for forming metal seals in the wellbore.

15. The method of claim 10, wherein outputting the third thermal energy into the wellbore comprises removing a contaminant in the wellbore.

16. The method of claim 10, wherein outputting the third thermal energy into the wellbore comprises igniting an ignitable payload outside of the downhole tool to melt or blast rocks in a formation through which the wellbore traverses.

17. A compact heat source comprising:

a housing;

an inner housing having thermal insulation disposed therein, the thermal insulation configured to retain thermal energy within the compact heat source;

a first heat source configured to be selectively activated to generate first thermal energy;

a second heat source disposed in the housing, wherein the second heat source is configured to be activated by the first thermal energy, wherein the second heat source comprises at least two metals that produce a first exothermic reaction in response to the first thermal energy, and wherein the first exothermic reaction is configured to generate second thermal energy;

a thermal insulation channel having a conical inner surface formed with a thermally insulating material configured to concentrate the second thermal energy at an output of the thermal insulation channel;

a third heat source in the housing, wherein the third heat source is configured to be activated by the concentrated second thermal energy, wherein the third heat source comprises thermite that produces a second exothermic reaction in response to the concentrated second thermal energy, and wherein the second exothermic reaction is configured to generate third thermal energy; and an output seal that encapsulates the third heat source in the housing, wherein the output seal is configured to be expelled or melted by the second exothermic reaction to permit the third thermal energy to exit the compact heat source.

18. The compact heat source of claim 17, wherein at least one of the at least two metals comprises a compacted powder, a thin wire, a thin film, or any combination thereof, having at least one dimension of less than 100 μm.

19. The compact heat source of claim 17, wherein the first heat source comprises an electrically activated heat source configured to generate temperatures of at least 400° C. in excess of 10 W/cm2.

20. The compact heat source of claim 17, wherein the first heat source comprises an electrically activated heat source configured to generate enough thermal energy in the first thermal energy to activate the second heat source using less than 250 W of power.

* * * * *